US005544878A

United States Patent [19]

Hsu

[11] Patent Number: 5,544,878

[45] Date of Patent: Aug. 13, 1996

[54] RACKET

[76] Inventor: Henry Hsu, No. 121, Section 1, Shen Lin Rd., Taya Hsiang, Taichung Hsien, Taiwan

[21] Appl. No.: 526,316

[22] Filed: Sep. 11, 1995

[51] Int. Cl.[6] ..... A63B 49/02

[52] U.S. Cl. ..... 273/73 C; 273/73 R; 273/73 G

[58] Field of Search ..... 273/73 R, 73 C, 273/73 G

[56] References Cited

U.S. PATENT DOCUMENTS

| | | | |
|---|---|---|---|
| 4,561,655 | 12/1985 | Mortvedt | 273/73 CX |
| 5,076,583 | 12/1991 | Hsu | 273/73 C |
| 5,211,691 | 5/1993 | Sol | 273/73 C |
| 5,299,801 | 4/1994 | Sol et al. | 273/73 C |
| 5,312,102 | 5/1994 | Stennett | 273/73 C |

*Primary Examiner*—Raleigh W. Chiu

*Attorney, Agent, or Firm*—Morton J. Rosenberg; David I. Klein

[57] ABSTRACT

A racket includes a head portion, a throat portion including two rods and a handle, at least one of the head portion and/or the throat portion has a segment having an ovoid cross section when taken in a plane orthogonal to an axis of the segment thereof, the ovoid cross section having a front arc, a rear arc, an inner arc, an outer arc and four quadrant arcs, the front/rear arc inscribed to an imaginary circle with radius R0 at point A which is located on a vertical central line of the imaginary circle, the profile of first quadrant and the second quadrant of the cross section being symmetrical to that of the third quadrant and the fourth quadrant of the cross section about a horizontal central line, the respective extension curve of the first quadrant arc and the second quadrant arc intersecting at two points one of which is located above the point A, the length of any radius of the four quadrant arcs being equal to 1.02–1.25 times that of the R0 and the widest portion of the cross section being less than 2R0.

2 Claims, 4 Drawing Sheets

RACKET

BACKGROUND OF THE INVENTION

1. Field of Invention

The present invention relates to a racket and more particularly, to a racket such as a tennis racket a badminton racket, except for the handle, having an ovoid cross section when taken in a plane orthogonal to an axis of a segment of the head.

2. Related Prior Art

A known racket is disclosed in U.S. Pat. No. 5,076,583 entitled as "Racket frame with circular cross section and variable thickness", filed on Aug. 21, 1990 to Henry Hsu, the racket including a head portion, a throat portion, a bridge and a handle portion, the frame of the head portion in accordance with the above mentioned patent has a circular cross section which diameter can be varied such as shown in FIGS. 1 through 5 of the patent so as to has an improved aerodynamic feature and hitting response. In fact, the circular cross section has a larger air resistance area than that of an elliptical cross section as shown in FIGS. 1 and 2 of another type of tennis racket, the frame 11 of the head portion 10 of the latter racket has a narrower surface when viewed orthogonal to a string area 12 of the racket, but the racket shown in FIGS. 1 and 2 has a larger drop "D" measured from the string area 12 to each distal end of the cross section of the frame 11, therefore, when a ball 13, shown in phantom lines, is stricken on the abutment of the frame 11 and the string area 12 of the head portion 10 as shown in FIG. 2, the response trajectory of the ball 13 is directly affected by the frame 11 rather than the string area 12 when the head portion 10 has a larger drop "D", on the other hand, the effective striking area of this kind of racket is reduced. Therefore, neither the racket disclosed in U.S. Pat. No. 5,076,583 nor the racket shown in FIGS. 1 and 2 can provide a racket which has a low air resistance area and a larger effective striking area.

The present invention intends to provide a racket which head has an ovoid cross section, except for the handle, when taken in a plane orthogonal to an axis of the segment of the frame wherein the ovoid cross section includes a front arc, a rear arc, an inner arc, an outer arc and four connecting arcs, each of the connecting arcs smoothly connected between the front arc and the inner arc, the inner arc and the rear arc, the front arc and the outer arc and, the outer arc and the rear arc so as to form the racket with suitable stiffness, less air resistance surface and a small drop measured from the string area to the rear or front arc of the frame.

SUMMARY OF THE INVENTION

The present invention provides a racket which includes a head portion, a throat portion which includes two rods and a handle, at least one of the head portion and/or the throat portion has a segment having an ovoid cross section when taken in a plane orthogonal to an axis of the segment thereof, the ovoid cross section having a front arc, a rear arc, an inner arc, an outer arc and four quadrant arcs.

The front/rear arc is inscribed to an imaginary circle with radius R0 at point A which is located on a vertical central line of the imaginary circle, the profile of first quadrant and the second quadrant of the cross section being symmetrical to that of the third quadrant and the fourth quadrant of the cross section about a horizontal central line, the respective extension curve of the first quadrant arc and the second quadrant arc intersecting at two points one of which is located above the point A, the length of any radius of the four quadrant arcs being equal to 1.025–1.25 times that of the R0 and the widest portion of the cross section being less than 2R0.

It is an object of the present invention to provide a racket which head has an ovoid cross section.

It is an object of the present invention to provide a racket which head has a suitable stiffness, a better aerodynamic feature and a small drop measured from the string area to the front/rear arc.

Other objects, advantages, and novel features of the invention will become more apparent from the following detailed description when taken in conjunction with the accompanying drawings.

DETAILED DESCRIPTION OF THE PREFERRED EMBODIMENT

Figure 2:
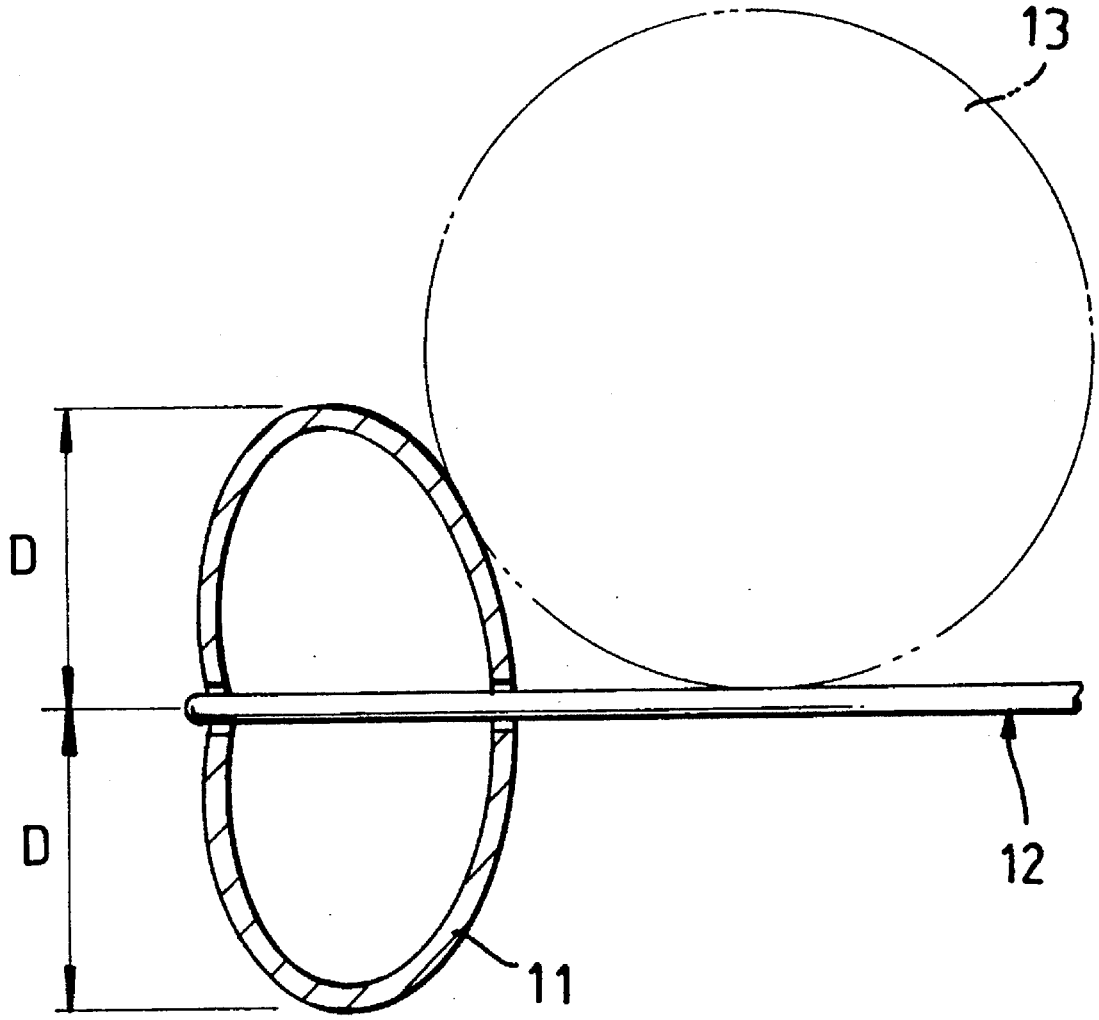
FIG. 2 PRIOR ART
FIG. 2 is a cross sectional view of the frame of the head portion of the conventional racket when taken in a plane orthogonal to an axis of a segment of the frame.
Figure 3:
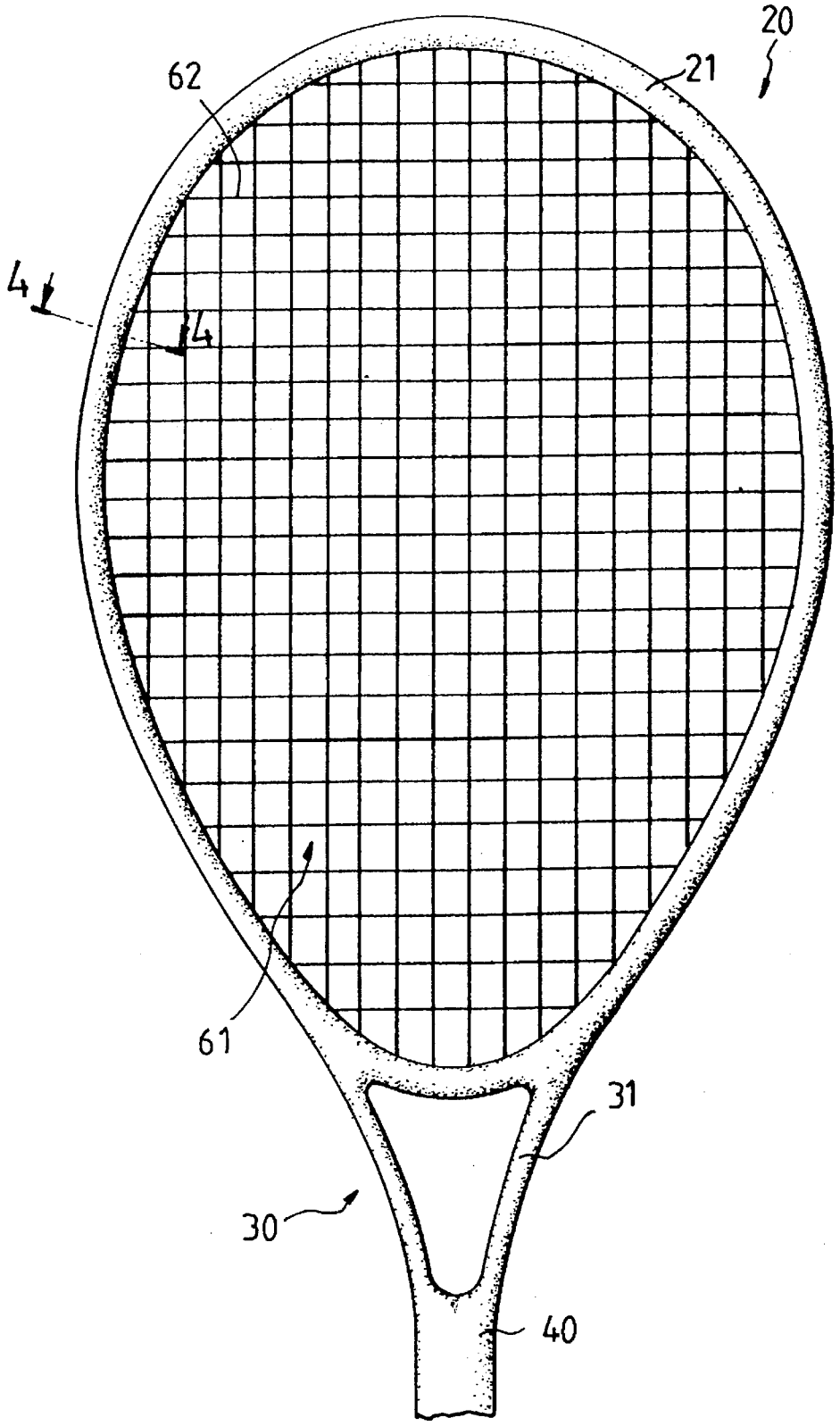
FIG. 3 is a front plane view of a racket in accordance with the present invention.
Figure 4:
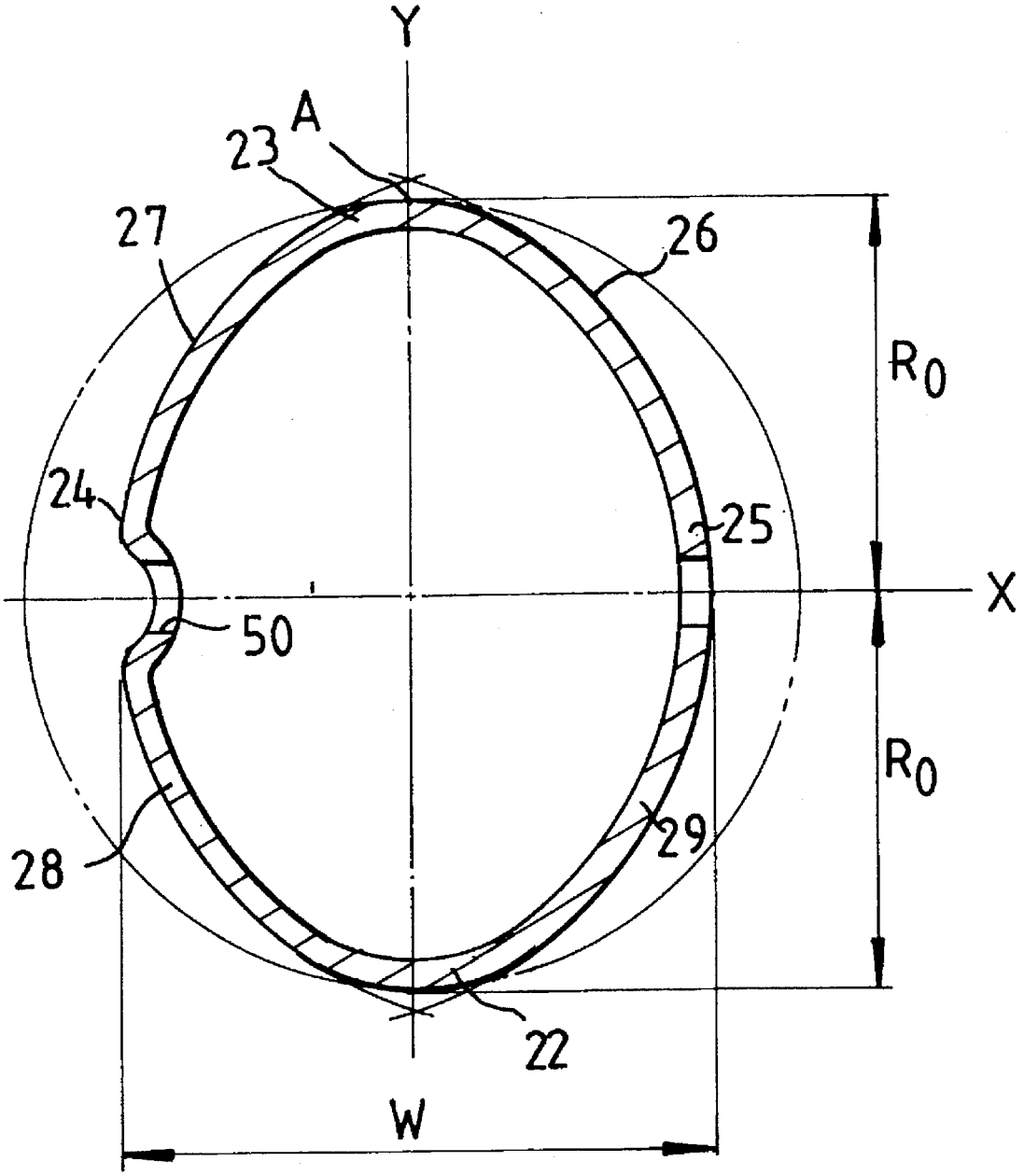
FIG. 4 is a cross sectional view of the frame of the head portion of the conventional racket when taken in a plane orthogonal to an axis of a segment of the frame.

Referring to FIGS. 3 and 4, a racket in accordance with the present invention, a tennis racket for example, generally includes a head portion 20, a throat portion 30 and a handle 40, the throat portion 30 including two rods and disposed between the head portion 20 and the handle 40, at least one segment of the head portion 20 and/or the throat portion 30 having an ovoid cross section when taken in a plane orthogonal to an axis of the segment, the ovoid cross section having a front arc 22, a rear arc 23, an inner arc 24, an outer arc 25 and four quadrant arcs which are a first quadrant arc 26, a second quadrant arc 27, a third quadrant arc 28 and a fourth quadrant arc 29. The rear arc 23 is connected between the first quadrant arc 26 and the second quadrant arc 27, the outer arc 25 is connected between the first quadrant arc 26 and the fourth quadrant arc 29, the Front arc 22 is connected between the fourth quadrant arc 29 and the third quadrant arc 28 and, the inner arc 24 is connected between the third quadrant arc 28 and the second quadrant arc 29. The front arc 22 and the rear arc 23 are respectively inscribed to an imaginary circle with radius R0 at point A which is located on a vertical central line, the Y axis, of the imaginary circle and, a profile of the first quadrant and the second quadrant of the cross section being symmetrical to that of the third quadrant and the fourth quadrant of the cross section about a horizontal central line, the X axis. The respective extension curve of the first quadrant arc 26 and the second quadrant arc 27 intersects at two points one of which is located above the point A on the Y axis as shown in FIG. 2. The length of any radius of the four quadrant arcs 26 to 29 is equal to 1.025–1.25 times that of R0 and the widest portion (W) of the cross section is less than 2R0. Furthermore, the radius of the first/fourth quadrant arc and the radius of the second/third quadrant arc may different.

A hole 50 is respectively defined in the segment of the frame 21 and which is corresponding to the inner arc 24 and the outer arc 25 for a string 62 extending therebetween to form a string area 61.

Accordingly, the present invention has the following advantages:

1) The air resistance surface, viewed orthogonal to the string area, is less than that of the racket with a circular cross section such that the racket in accordance with the present invention has a better aerodynamic feature and an uniform strength.

Figure 1:
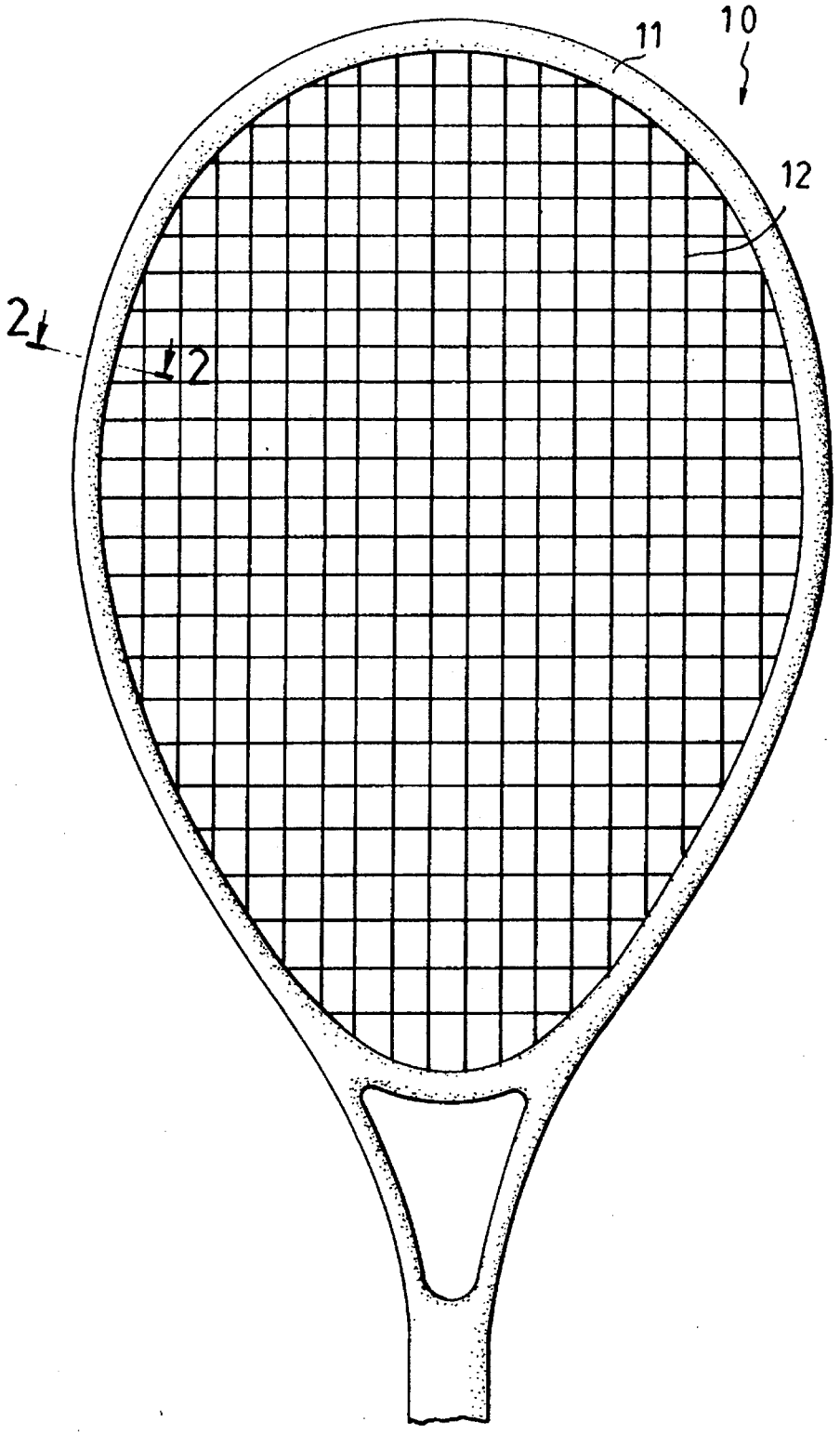
FIG. 1 PRIOR ART
FIG. 1 is a front plane view of a conventional racket.

2) Under the same cross sectional area condition, the drop measured from the string area 61 to the front arc 22 or the rear arc 23 of the frame 21 is less than that of the racket shown in FIGS. 1 and 2 such that the racket in accordance with the present invention has a larger effective string area.

3) The ovoid cross section has a better stiffness and an uniform strength than other shapes of cross sections.

Although the invention has been explained in relation to its preferred embodiment, it is to be understood that many other possible modifications and variations can be made without departing from the spirit and scope of the invention as hereinafter claimed.

I claim:

1. A racket comprising a head portion, a throat portion and a handle, said throat portion including two rods and disposed between said head portion and said handle, at least one segment of said head portion and/or said throat portion having an ovoid cross section when taken in a plane orthogonal to an axis of said segment, said ovoid cross section having a front arc, a rear arc, an inner arc, an outer arc and four quadrant arcs which are a first quadrant arc, a second quadrant arc, a third quadrant arc and a fourth quadrant arc, said rear arc connected between said first quadrant arc and said second quadrant arc, said outer arc connected between said first quadrant arc and said fourth quadrant arc, said front arc connected between said fourth quadrant arc and said third quadrant arc and, said inner arc connected between said third quadrant arc and said second quadrant arc, said front arc and said rear arc respectively inscribed to an imaginary circle with radius R0 at point A which is located on a vertical central line of said imaginary circle, a profile of a first quadrant and a second quadrant of said cross section being symmetrical to that of said third quadrant and said fourth quadrant of said cross section about a horizontal central line, a respective extension curve of said first quadrant arc and said second quadrant arc intersecting at two points one of which is located above said point A, a length of any radius of said four quadrant arcs being equal to 1.025–1.25 timers that of R0 and the widest portion of said cross section being less than 2R0.

2. The racket as claimed in claim 1 wherein said radius of said first quadrant arc and said radius of said second quadrant arc are different.

* * * * *